US010841691B2

(12) United States Patent
Congard

(10) Patent No.: US 10,841,691 B2
(45) Date of Patent: Nov. 17, 2020

(54) SOUND SYSTEM FOR VIDEO SCREENS

(71) Applicant: Screen Excellence Ltd., Rendlesham (GB)

(72) Inventor: Patrice Bernard François Congard, Ipswich (GB)

(73) Assignee: Screen Excellence Ltd., Rendlesham (GB)

( * ) Notice: Subject to any disclaimer, the term of this patent is extended or adjusted under 35 U.S.C. 154(b) by 0 days.

(21) Appl. No.: 16/552,098

(22) Filed: Aug. 27, 2019

(65) Prior Publication Data

US 2020/0068295 A1 Feb. 27, 2020

(30) Foreign Application Priority Data

Aug. 27, 2018 (FR) ..... 18 00907

(51) Int. Cl.
*H04R 9/06* (2006.01)
*H04R 1/34* (2006.01)
(Continued)

(52) U.S. Cl.
CPC ..... *H04R 1/345* (2013.01); *H04R 1/025* (2013.01); *H04R 1/026* (2013.01); *H04R 1/403* (2013.01);
(Continued)

(58) Field of Classification Search
CPC . H04R 1/00; H04R 1/02; H04R 1/025; H04R 1/026; H04R 1/32; H04R 1/323; H04R 1/34; H04R 1/345; H04R 1/347; H04R 1/40; H04R 1/403; H04R 1/42; H04R 3/00; H04R 3/04; H04R 3/06; H04R 3/07; H04R 3/12; H04R 2201/021;
(Continued)

(56) References Cited

U.S. PATENT DOCUMENTS 5,210,802 A 5/1993 Aylward
5,809,150 A 9/1998 Eberbach
(Continued)

FOREIGN PATENT DOCUMENTS

JP 2012-49663 3/2012

*Primary Examiner* — Leshui Zhang
(74) *Attorney, Agent, or Firm* — Howson & Howson LLP

(57) ABSTRACT

A sound system for use with a non-acoustically transparent video screen (1) is disclosed, comprising at least one loudspeaker enclosure (10) comprising a loudspeaker (15) arranged so that the main direction of propagation of the sound (33) which it emits is directed towards said screen, the sound being reflected by the surface of the screen towards an audience (2). The enclosure (10) further comprises a second sound emitter (16/20) situated at the rear of said loudspeaker (15), whereby the loudspeaker enclosure has a directivity of the cardioid type. The second sound emitter may, for example, comprise an opening, combined with a defined quantity of acoustically absorbent material (17) arranged inside the enclosure (10) between the rear of the loudspeaker (15) and the opening (16); alternatively, it may comprise at least one second loudspeaker (20) situated so as to be substantially directed towards the audience (2), said second loudspeaker (20) being connected with a reversed polarity with respect to the principal loudspeaker (15).

12 Claims, 8 Drawing Sheets

(51) Int. Cl.

| | |
|---|---|
| ***H04R 3/04*** | (2006.01) |
| ***H04R 1/02*** | (2006.01) |
| ***H04R 1/40*** | (2006.01) |
| ***H04R 3/12*** | (2006.01) |

(52) U.S. Cl.
CPC ..... *H04R 3/04* (2013.01); *H04R 3/12* (2013.01); *H04R 2201/021* (2013.01)

(58) Field of Classification Search
CPC ..... H04R 2201/02; H04R 2201/00; H04R 2201/029; G10K 11/178; G10K 11/1787; G10K 11/17873; G10K 11/17881; G10K 11/17861; G10K 11/17854; G10K 11/17853; G10K 11/1785; G10K 11/17823; G10K 11/17819; G10K 11/17813
USPC ..... 381/1, 17–23, 300–311, 325, 77, 80, 81, 381/82, 85, 61, 111, 116, 117, 97, 98, 99, 381/100, 101, 102, 103, 71.8
See application file for complete search history.

(56) References Cited

U.S. PATENT DOCUMENTS

| | | | | |
|---|---|---|---|---|
| 9,807,496 | B1 * | 10/2017 | Hecht | H04R 1/2819 |
| 2005/0249356 | A1 * | 11/2005 | Holmi | H04S 7/30 381/86 |
| 2006/0251271 | A1 | 11/2006 | Grimani | |
| 2009/0324003 | A1 | 12/2009 | Stewart, Jr. et al. | |
| 2013/0279716 | A1 | 10/2013 | Hartung et al. | |
| 2017/0026750 | A1 * | 1/2017 | Mansfield | H04S 7/301 |
| 2018/0048846 | A1 | 2/2018 | Ko et al. | |
| 2019/0045320 | A1 * | 2/2019 | Peace, Jr. | H04N 9/30 |
| 2020/0068294 | A1 * | 2/2020 | Slack | H04R 3/14 |

* cited by examiner

SOUND SYSTEM FOR VIDEO SCREENS

FIELD OF THE INVENTION

The present invention relates to sound systems for use with video screens, in particular video screens of the non-acoustically transparent type.

BACKGROUND OF THE INVENTION

Two conventional types of sound systems for video screens are known.

A first type of video screen sound system reproduces the characteristics of similar devices used in cinemas. Applicable solely to acoustically transparent projection screens, either perforated or woven, it consists in the arrangement of one or three loudspeaker enclosure(s) behind the screen, so that the emitted sound passes through said screen. The advantage of such a device is that it permits spatial coherence between the sound and the image: the sound is perceived as originating from the image, which corresponds to the expectation of the audience.

A second type of video screen system applies to non-acoustically transparent screens, such as televisions, active screens, or even non-acoustically transparent projection screens. In this type of system, one or three loudspeaker enclosure(s) are arranged beneath or above the screen. The disadvantage of such a system is that it creates an inconsistency between the location of the sound source and the image produced on the screen. This disadvantage is considered to be minor and acceptable when the screen is small, e.g. not exceeding 150 cm in diagonal. However, non-acoustically transparent screens are increasingly exceeding this size and cannot be provided with sound satisfactorily by conventional means.

SUMMARY OF THE INVENTION

The present invention seeks to provide a sound system for use with a non-acoustically transparent screen, for example a hard and reflecting surface such as a sheet of glass, in which the apparent location of one or several sound sources is located in the screen.

More precisely, a sound system according to the present invention, for use with a video screen arranged facing an audience, comprises at least one loudspeaker enclosure arranged so that the principal direction of propagation of the sound which it emits is directed towards said screen, the sound being reflected by the surface of the screen along a direction towards the audience, said at least one enclosure having a directivity of the cardioid or hyper-cardioid type. The said direction of propagation of sound is such that the audience will perceive the sound to emanate from the screen.

More generally, the invention involves at least one loudspeaker enclosure comprising at least one main loudspeaker directed towards a screen, such that its main lobe of directivity is directed substantially towards said screen.

The sound system in accordance with the invention is for use with a non-acoustically transparent video screen, and comprises at least one loudspeaker enclosure comprising a loudspeaker arranged so that the main direction of propagation of the sound which it emits is directed towards said screen, the sound being reflected by the surface of the screen towards an audience. The sound system is characterized in that said enclosure further comprises a second sound emitter situated at the rear of said loudspeaker, whereby the loudspeaker enclosure has a directivity of the cardioid type.

The second sound emitter preferably comprises an opening situated at the rear of said loudspeaker and a defined quantity of acoustically absorbent material arranged inside the enclosure between the rear of the speaker and the opening, giving said enclosure a directivity of the hyper-cardioid type.

The quantity of absorbent material can be adjusted so that an axis of minimum sound radiation defining the directivity of the enclosure is substantially oriented in the direction of the audience.

Preferably the opening of the second sound emitter has a surface area at least equal to half the surface area of the loudspeaker.

The second sound emitter can comprise at least one second loudspeaker situated so as to be substantially directed towards the audience, with the second loudspeaker connected with a reversed polarity with respect to the principal loudspeaker.

The second loudspeaker can receive a signal which is modified with respect to the signal received by the principal loudspeaker. This modified signal can be delayed, equalized and low-pass filtered with the aid of digital processing means of the signal so as to reduce the sound level emitted by the set of loudspeakers along an axis substantially oriented in the direction of the audience.

In an embodiment of the invention, the enclosure can be fixed to the ceiling of a room. In this case, the enclosure preferably has a front face inclined at an angle between 15° and 45° with respect to the vertical, so that the loudspeaker is directed towards the screen when the enclosure is fixed to the ceiling.

The enclosure can have an asymmetrical shape about a vertical axis, so that the loudspeaker is directed towards the screen when the enclosure is placed on the ground.

The enclosure can also comprise a plurality of loudspeakers.

The sound system can comprise at least three identical enclosures directed towards the screen, each of these enclosures receiving an individual signal.

The sound system can further comprise at least one additional loudspeaker enclosure arranged close to the screen and directed towards the audience, the first-mentioned at least one loudspeaker enclosure receiving a high-pass filtered signal at a frequency between 40 Hz and 200 Hz, and said additional loudspeaker enclosure receiving a low-pass filtered signal at a frequency substantially equal to that of the high-pass filter, and delayed with respect to the signal received by the first-mentioned at least one loudspeaker enclosure.

In some embodiments, a plurality of loudspeaker enclosures can be utilised, preferably at least three, and these may be, for example, dedicated respectively to the reproduction of the left, center and right channels of cinema sound tracks.

BRIEF DESCRIPTION OF THE DRAWINGS

The invention is hereinafter described in more detail by way of example only, with reference to the accompanying drawings, in which.

DETAILED DESCRIPTION

Figure 1:
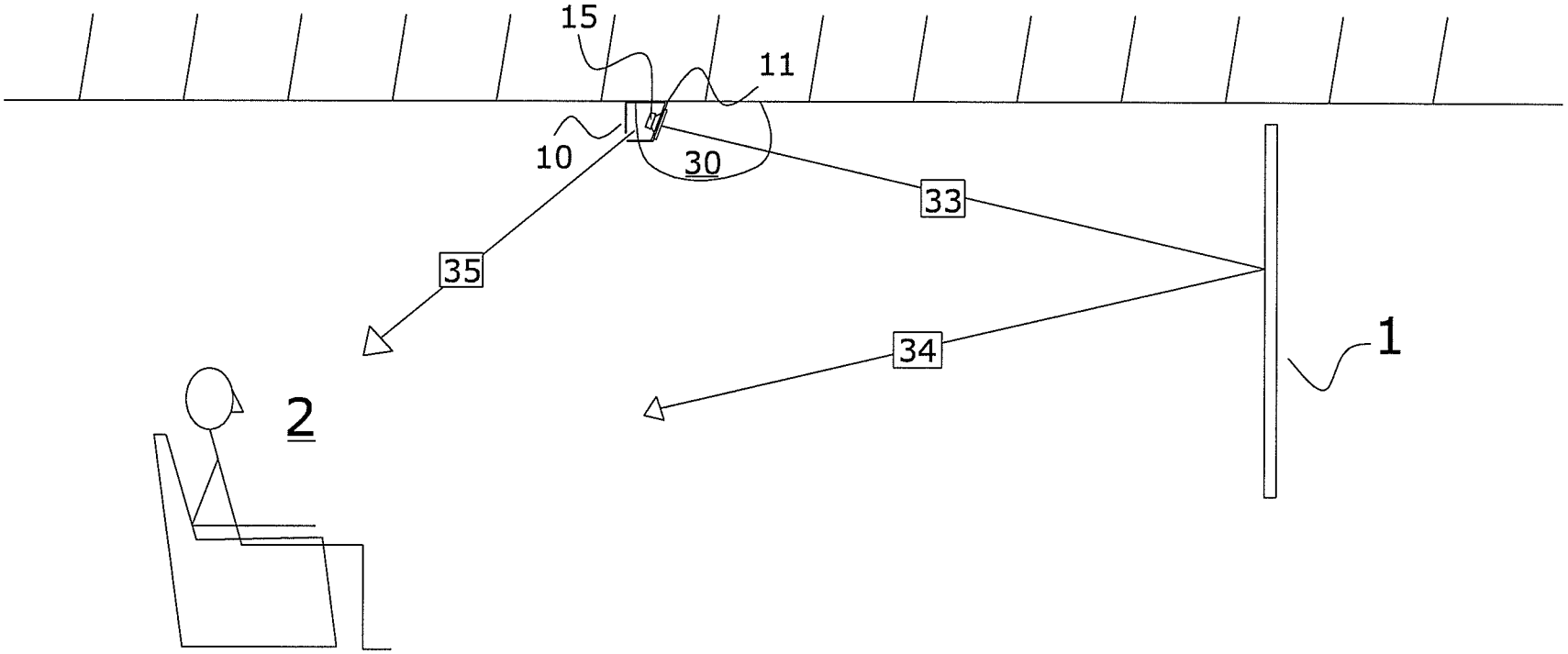
FIG. 1 is a diagrammatic representation in side elevation of an embodiment of sound system according to the invention.

According to a first embodiment of the invention represented in FIG. 1, a location in which the embodiment is installed includes a video screen 1 facing an audience 2 represented symbolically by a seated silhouette. The location will typically be enclosed, comprising a floor, a ceiling and walls, not all of which are represented in the drawing. A loudspeaker enclosure 10 is fixed to ceiling. It comprises a face designated as front face 11, inclined with respect to its principal axis. The front face receives at least one loudspeaker, designated principal loudspeaker 15. The enclosure 10 is fixed to the ceiling at a distance from the screen 1 such that the direction of emission of the principal loudspeaker 15 is substantially directed towards the horizontal median line of said screen. The enclosure 10, according to the first embodiment of the invention, has a directivity of the cardioid type over the whole of the band of low frequencies which it reproduces, it being understood that the reproduction of high frequencies involves an intensified, or controlled, directivity, linked to the physical dimensions of the principal loudspeaker 15 or of additional loudspeakers placed on the front face 11 of the enclosure 10.

Loudspeaker enclosures with cardioid directivity are known per se, and do not themselves constitute the essence of the present invention. Rather, the invention involves the arrangement and positioning of such an enclosure with cardioid directivity, orientated with its front face towards a video screen.

FIG. 1 also illustrates a main lobe of directivity 30, defined symbolically by a contour of equal sound pressure.

The positioning of the enclosure 10 fixed to the ceiling entails a modification of the shape of the lobe of directivity 30, the latter no longer being purely cardioid, but semi-cardioid, owing to the immediate proximity of the ceiling. Indeed, the sound emission of the enclosure is made in a half-space, owing to its positioning on the ceiling. With reference to the drawing, the sound therefore propagates in the direction of the lobe of directivity 30 along the axis 33, then is reflected off the surface of the screen 1 to direct itself along the axis 34 in the direction of the audience 2.

The obtaining of a semi-cardioid directivity can require modifications to the shape and structure of the enclosure 10 with respect to a conventional cardioid enclosure, which modifications are comprised within the present invention.

Figure 2:
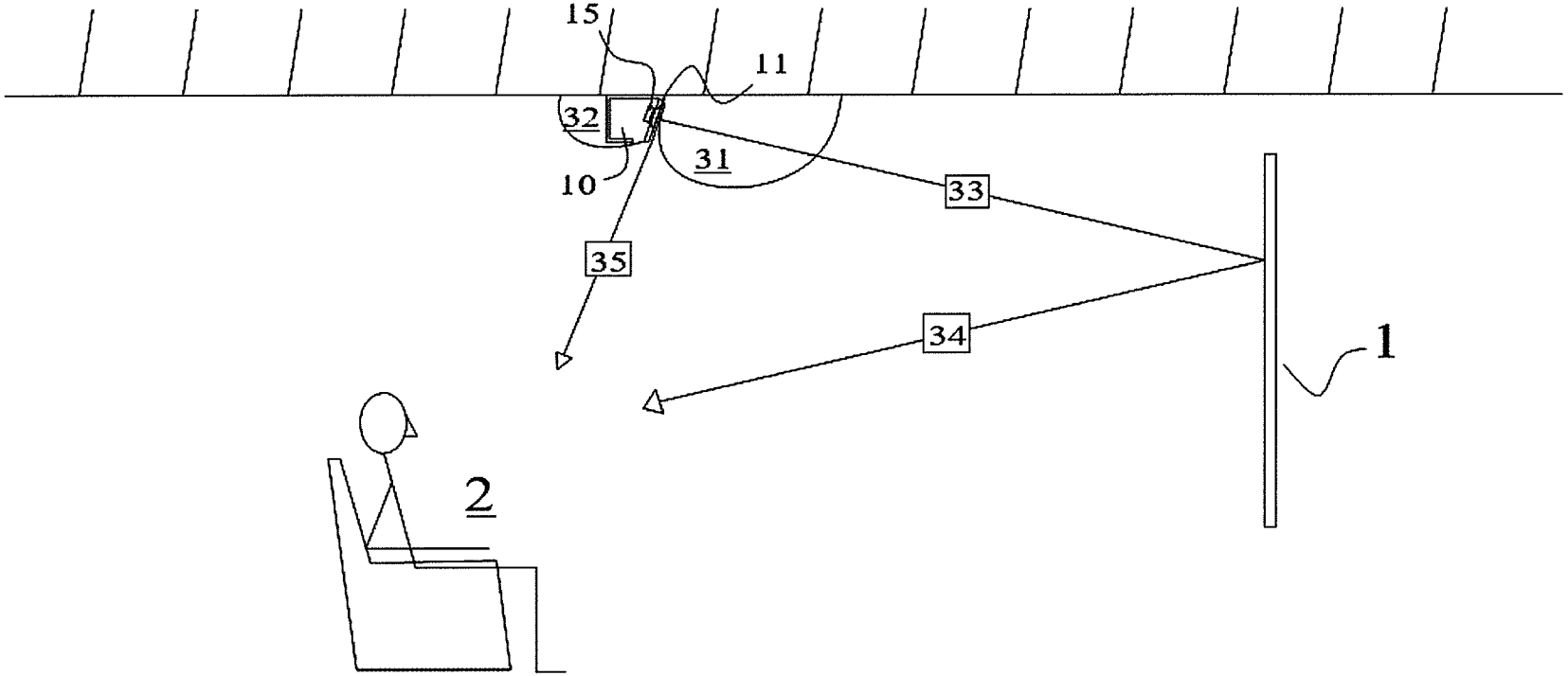
FIG. 2 is a diagrammatic representation in side elevation of an alternative embodiment of sound system according to the invention.

With reference to FIG. 2, a second embodiment of the invention is illustrated, which comprises similar essential elements to the first embodiment. In the second embodiment, the loudspeaker enclosure 10 has a semi-hyper-cardioid directivity, generating two lobes of directivity 31 and 32 in phase opposition.

In the two illustrated embodiments, the enclosure 10 has a principal loudspeaker 15 directed approximately towards the horizontal median line of the screen 1. The sound is therefore propagated in this direction along the axis 33, then is reflected off the surface of the screen 1 to direct itself along the axis 34 in the direction of the audience 2.

The enclosure 10 being closer to the audience 2 than the screen 1, it would be perceived as being the origin of the sound if its directivity were omnidirectional, which is the case for the majority of conventional loudspeaker enclosures with low frequencies.

With regard to an enclosure with semi-cardioid or semi-hyper-cardioid directivity, the emission of the sound presents a minimum along an axis 35 (FIGS. 1 and 2) defined by the distinctive characteristics of said enclosure 10.

The relative positioning of the enclosure 10 and of the screen 1 is arranged so that the axis 35 of minimum sound emission of the enclosure is directed as a whole towards the audience 2 and the axis 34 corresponding to the maximum sound emission reflected off the surface of the screen 1 is directed as a whole towards the audience 2.

Thus, the maximum sound level is perceived by the audience as originating from the surface of the screen, which is the main object of the present invention.

It is known that an effect known as precedence exists, which allows a sound source to be perceived as being located, not as a function of its amplitude, but as a function of the arrival of the sound wave from said source before the arrival of one originating from a secondary source emitting the same sound. However, this precedence effect only occurs at relatively high frequencies, typically greater than 1 kHz. At these frequencies, the loudspeakers can be naturally directive by their dimensions alone, and therefore do not emit sound in the direction of the audience if said loudspeakers are oriented towards the screen 1, as is required by the present invention. At lower frequencies, the perceived location of a sound source with respect to secondary sources is made principally by the comparison of the sound levels.

During operation of the invention, the sound level generated by the enclosure 10 is maximum in the direction of the screen 1, and then in the direction of the audience 2 after reflection from the surface of the screen 1. The sound level directly generated by the enclosure 10 is minimum in the direction of the audience 2, and despite the relative proximity of the enclosure 10 and of the audience 2, the enclosure will not be perceived as the origin of the sound. Instead, the sound will be perceived as originating from the site of reflection, i.e. the screen 1.

Figure 3:
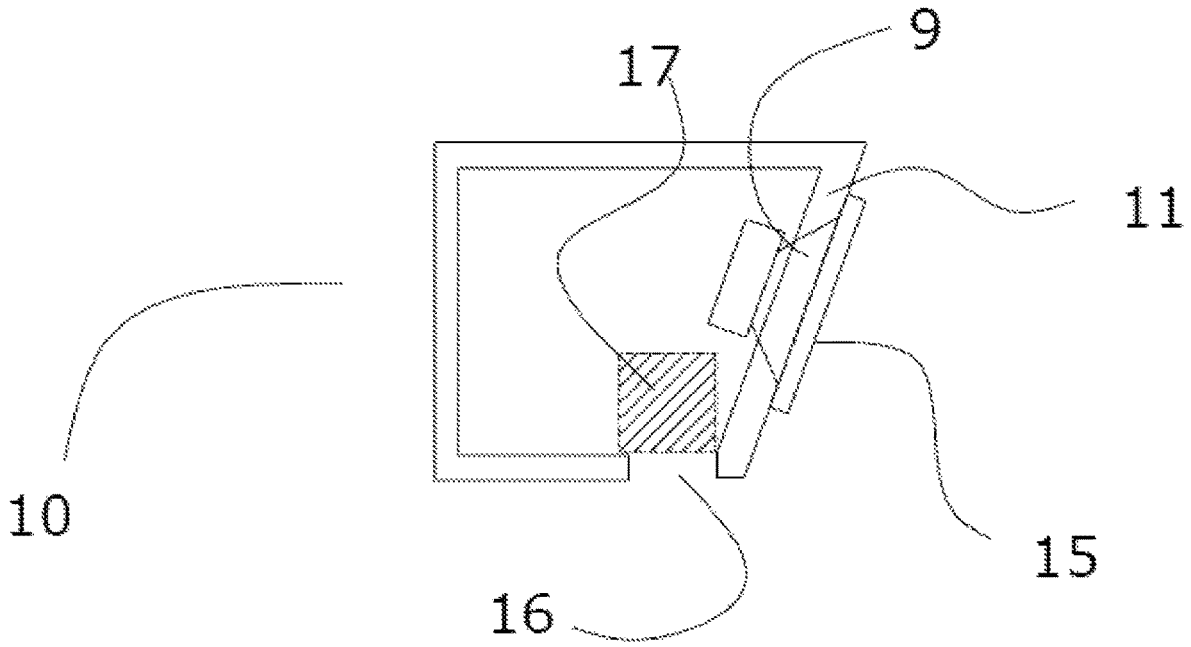
FIG. 3 is a detailed representation in longitudinal section of a loudspeaker enclosure for use in an embodiment of sound system according to the invention.

FIG. 3 represents an embodiment of loudspeaker enclosure 10 in longitudinal section according to the present invention. The enclosure 10 comprises a loudspeaker 10, arranged on an inclined front face 11, such that the main lobe of directivity 30 is directed towards the screen 1 when the enclosure 10 is arranged on the ceiling of a room in which the screen is situated.

Preferably, the front face 11 is inclined by an angle of between 15° and 45° with respect to the vertical.

An opening 16 is provided at the rear of the loudspeaker 15, arranged in the lower face of the enclosure 10 when the latter is fixed to the ceiling, and having a dimension at least equal to half of the surface of said loudspeaker. The reference here to the surface of the loudspeaker 15 is to its emissive surface, i.e. its membrane.

Alternatively, the opening 16 can be arranged in the rear face of the enclosure 10, depending on the shape and the dimensions of said enclosure.

Preferably, the surface of the opening 16 is equal to or greater than the surface of the membrane of the loudspeaker 15.

The opening 16 permits the passage of sound waves emitted by the rear face 9 of the membrane of the loudspeaker 15, in phase opposition with the sound wave emitted by the front face of said loudspeaker.

This constitutes an acoustic short-circuit, creating a minimum sound emission in the plane connecting the rear of the loudspeaker 15 and the opening 16.

A specific quantity of acoustically absorbent material 17 is interposed between the rear face of the loudspeaker 15 and the opening 16. Such a material has the effect of slowing down the propagation of the sound, which modifies the direction along which the minimum sound emission will be produced.

The quantity of acoustic material and the exact positioning of the opening 16 allows the direction of the minimum sound emission 35 to be determined, such that the latter is oriented overall towards the audience 2.

Figure 4:
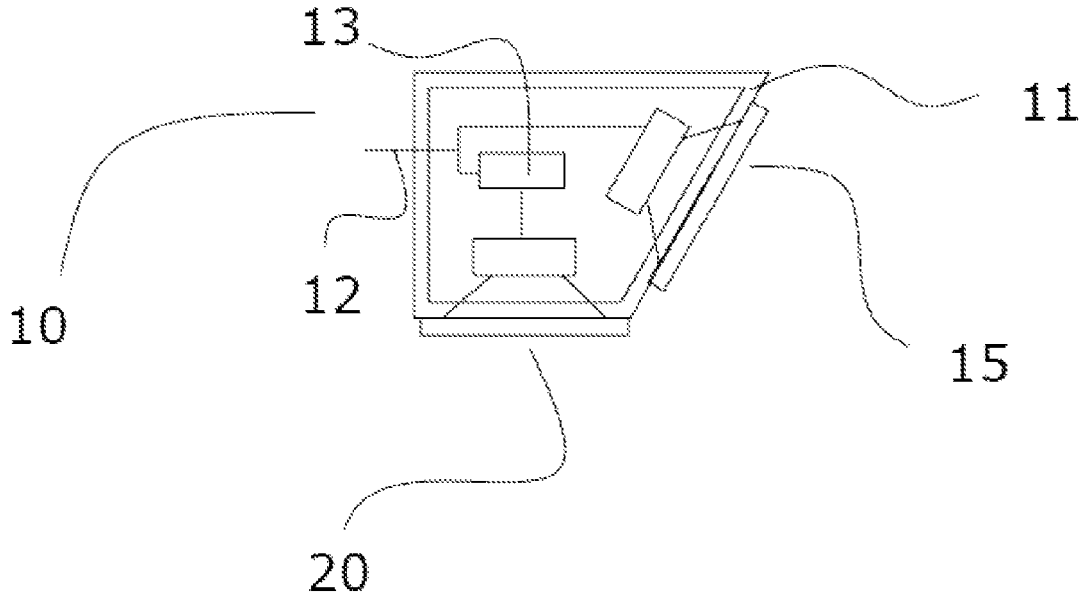
FIG. 4 is a detailed representation in longitudinal section of a loudspeaker enclosure for use in an alternative embodiment of sound system according to the invention.

FIG. 4 represents another variant embodiment of a loudspeaker enclosure for use in a sound system according to the present invention.

In this variant, a second loudspeaker 20 is arranged on the lower face of the enclosure 10, in place of the opening 16. Said second loudspeaker 20 is connected in reversed polarity with respect to the principal loudspeaker 15. It is supplied by a signal derived from the signal supplying the loudspeaker 15 through signal path 12, but the signal supplied to loudspeaker 20 is modified by digital processing means 13, which introduces delay, and performs low-pass filtering and equalizing functions.

The determining of the axis of a minimum sound emission 35 is, in this variant, facilitated by the use of digital processing means of the signal with respect to the embodiment previously described and illustrated in FIG. 3.

Figure 5:
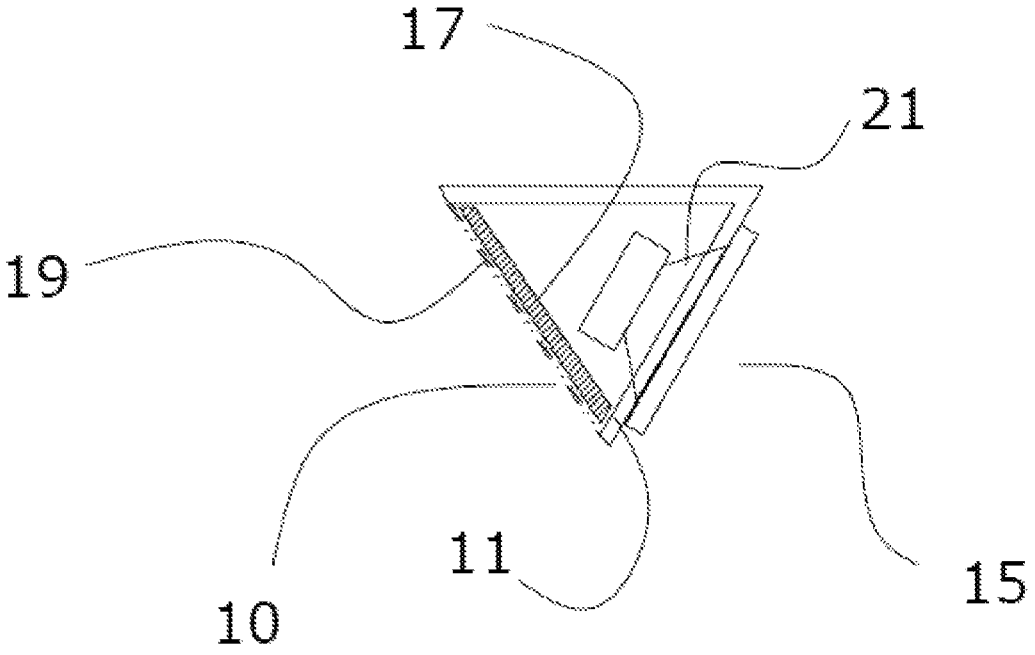
FIG. 5 is a detailed representation in longitudinal section of a loudspeaker enclosure for use in a further alternative embodiment of sound system according the invention.
Figure 6:
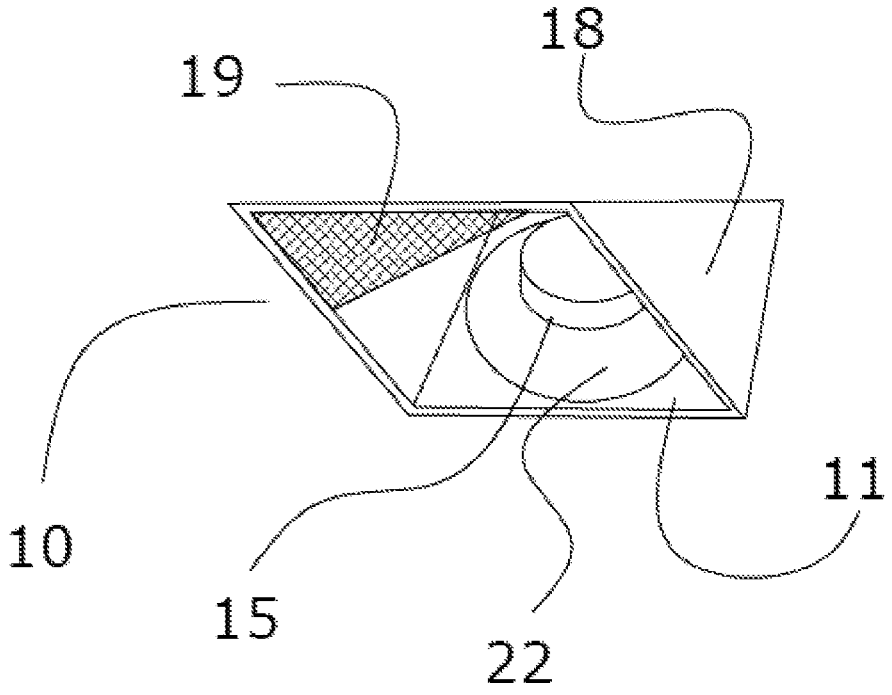
FIG. 6 is a representation in perspective of the loudspeaker enclosure of FIG. 5.

With reference to FIGS. 5 and 6, a loudspeaker enclosure 10 is constituted by a front face 11 inclined with respect to the vertical by an angle of between 15° and 45° to the vertical, said front face comprising a loudspeaker 15. As in the embodiment shown in FIG. 3, in FIGS. 5 and 6, sound waves emitted by the rear faces 21 and 22 of the membranes of the loudspeakers, are in phase opposition with the sound waves emitted by the front faces of the loudspeakers.

Two sides 18 extend on either side of, and from, the front face 11 along planes normal thereto. The sides 18 are terminated by edges 19, forming an overall triangular shape. A grille 19 is applied on the edges of the sides 18 so as to close the enclosure (shown only partially in FIG. 6). A specific quantity of absorbent material 17 is fixed to the grille 19, as internal covering of said grille (FIG. 5).

Advantageously, a housing may be provided in the ceiling, so that the enclosure can pivot about the junction between the front face 11 and the ceiling. When it is not being used, the enclosure 10 can then retract into the ceiling with the aid of retraction means known per se.

Preferably, the loudspeaker 15 is either of the broadband type, or coaxial, so as to reduce as much as possible the surface of the front face 11.

Figure 7:
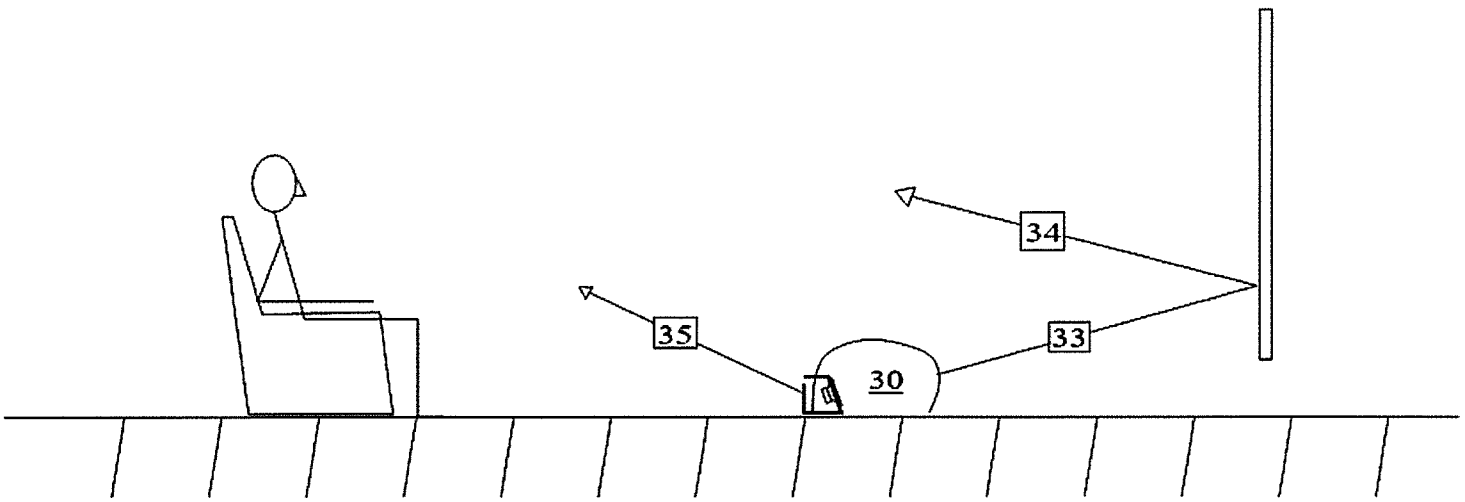
FIG. 7 is a diagrammatic representation in side elevation of an alternative arrangement of the embodiments of the invention previously presented.

FIG. 7 represents an alternative mode of use of embodiments of the invention, in which the enclosure 10 is placed on the ground. Overall, the enclosure 10 possesses the same characteristics as in the preceding examples; however, instead of being fixed to the ceiling, it is placed on the ground. In this case, the minimum sound emission direction 35 will be adjusted as a function of this positioning, so that it is oriented towards the audience 2.

Figure 8:
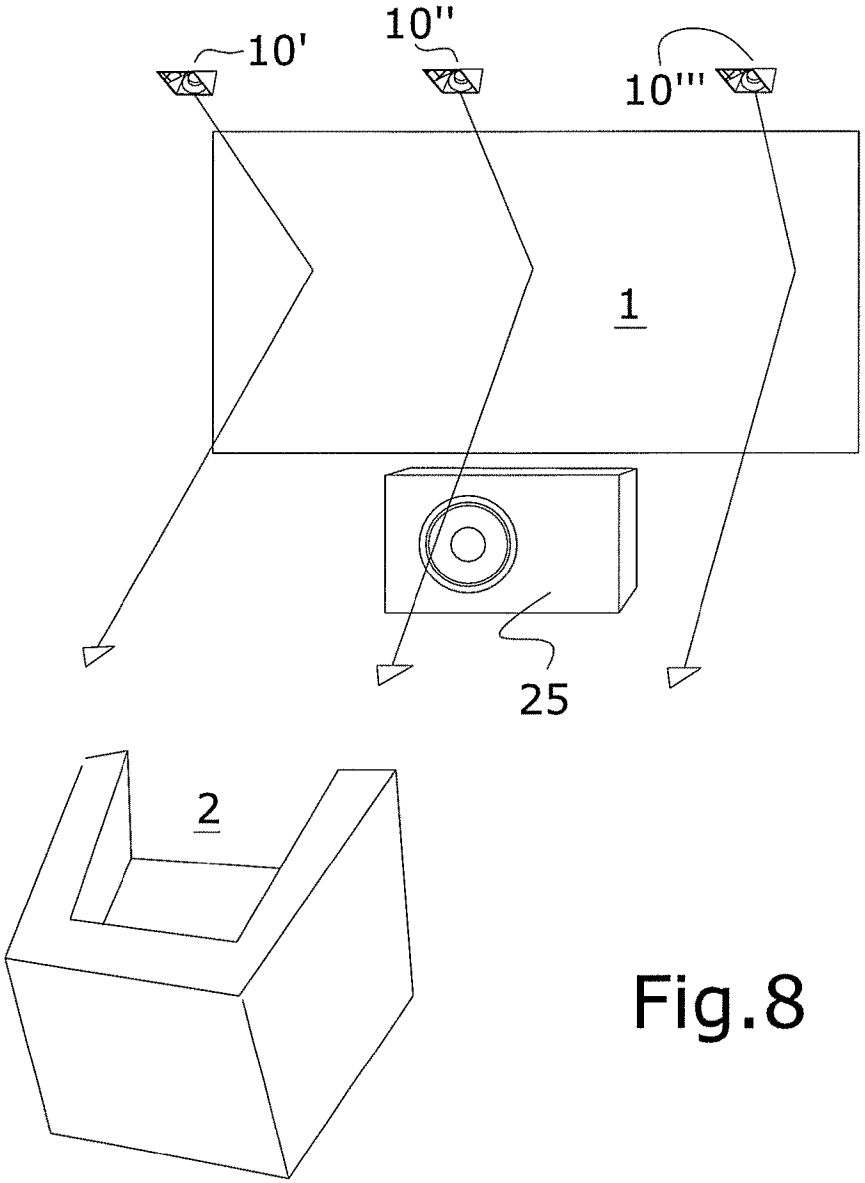
FIG. 8 is a diagrammatic representation in perspective of an embodiment of sound system according to invention, in a complete configuration.

FIG. 8 represents an embodiment of sound system according to the invention, as it might be configured in a real situation.

Sound reproduction of cinema sound bands requires configurations comprising at least 6 channels, according to a commercially designated 5.1 format, or possibly more channels, 5.1 being a minimum configuration. In such a 5.1 configuration, three of the channels, designated left, center and right, are allocated to the reproduction of the sounds corresponding to the images visible on the screen 1. The signals of the three left, center and right channels are respectively allocated to the supply of the enclosures 10', 10" and 10'''. The three enclosures 10', 10" and 10''' are oriented towards the horizontal median of the screen 1, the enclosure 10' being directed towards the left part of the screen, the enclosure 10" towards the center of the screen and the enclosure 10''' towards the right part. The signals of the left, center and right channels are filtered according to a high-pass function at a frequency of, for example, 100 Hz. The range of filtering frequencies extends from 40 Hz to 200 Hz within the scope of the invention, but in the majority of embodiments a range of frequencies comprised between 80 Hz and 120 Hz will be preferred.

In the illustrated embodiment, an additional loudspeaker enclosure 25 is arranged below the screen, and substantially in its vertical plane. It may, alternatively, be arranged above the screen. Such an enclosure may be of conventional type, preferably designed for the reproduction of low frequencies. A plurality of enclosures 25 may also be utilised, allocated to the same function and receiving the same signal, according to the sound level which one seeks to obtain. The enclosure 25 receives a signal of at least one of the left, center, right channels, or a signal obtained by adding two of these signals, or else of these three signals. The resulting signal is filtered according to a low-pass function at, for example, 100 Hz. It will be understood that the low-pass filtering frequency must substantially correspond to the high-pass frequency applied to the signals supplying the enclosures 10', 10" and 10'''.

Three enclosures may also be provided (which may be designated 25', 25" and 25''' but which are not shown), each receiving respectively one of the left, center, right signals, low-pass filtered at the same frequency.

A delay is applied to every signal which is low-pass filtered and supplying the enclosure(s) 25 or 25', 25", 25'''. This delay is intended to compensate for the difference in propagation time of the sound between an enclosure 10 and an enclosure 25 before reaching the audience 2. This difference originates from the fact that the sound originating from an enclosure 10 has propagated over a certain distance before reaching the screen 1, whereas the enclosure 25 is situated approximately in the vertical plane of the screen 1, the path of the sound before reaching the audience 2 being, in this case, shorter.

The use of one or more additional loudspeaker enclosure(s) 25 may be desirable, due to the fact, known per se, that loudspeaker enclosures producing cardioid or hypercardioid directivity generally have a very low output at low frequencies, namely for frequencies lower than 100 Hz.

The detailed description above of preferred embodiments of the invention is not intended to be restrictive, and is given by way of example only. Numerous modifications will be apparent to the person skilled in the art, within the scope of the following claims.

The invention claimed is:

1. A sound system comprising a screen, said screen being a non-acoustically transparent video screen, said sound system further comprising a loudspeaker enclosure fixed to the ceiling of a room or placed on the ground, said loudspeaker enclosure comprising a loudspeaker arranged so that a main direction of propagation of a sound emitted by said loudspeaker is directed towards said screen, said sound being reflected by a surface of said screen towards an audience, characterized in that said loudspeaker enclosure further comprises a second sound emitter situated at the rear of said loudspeaker adapted to emit sound in phase opposition to said sound emitted in said main direction of propagation by said loudspeaker, whereby said loudspeaker enclosure has a directivity selected from semi-cardioid type and semi-hypercardioid type, with the level of emitted sound being at a maximum in the direction of said screen and at a minimum in the direction of said audience.

2. The sound system according to claim 1, wherein said second sound emitter comprises an opening in said loudspeaker enclosure situated at the rear of said loudspeaker and a defined quantity of an acoustically absorbent material arranged inside said loudspeaker enclosure between the rear of said loudspeaker and said opening.

3. The sound system according to claim 2, characterized in that said defined quantity of said acoustically absorbent material is adjusted so that an axis of minimum sound radiation defining said directivity of said loudspeaker enclosure is substantially oriented in a direction toward said audience.

4. The sound system according to claim 2, wherein said opening has a surface area at least equal to half of an emissive surface area of said loudspeaker.

5. The sound system according to claim 4, characterized in that said defined quantity of said acoustically absorbent material is adjusted so that an axis of minimum sound radiation defining said directivity of said loudspeaker enclosure is substantially oriented in a direction toward said audience.

6. The sound system according to claim 1, wherein said loudspeaker constitutes a principal loudspeaker and wherein said second sound emitter comprises a second loudspeaker situated so as to be substantially directed towards said audience, said second loudspeaker being connected with a reversed polarity with respect to said principal loudspeaker.

7. The sound system according to claim 6, wherein said second loudspeaker receives a signal which is modified with respect to a signal received by said principal loudspeaker, said signal received by said second loudspeaker being delayed, equalized and low-pass filtered by a digital processing means so as to reduce a sound level emitted by said sound system along an axis substantially oriented toward said audience.

8. The sound system according to claim 1, wherein said loudspeaker enclosure is fixed to the ceiling of a room.

9. The sound system according to claim 8, wherein said loudspeaker enclosure has a front face inclined at an angle between 15° and 45° with respect to vertical axis, so that said loudspeaker is directed towards said screen when said loudspeaker enclosure is fixed to said ceiling.

10. The sound system according to claim 1, wherein said loudspeaker enclosure has an asymmetrical shape about a vertical axis, so that said loudspeaker is directed towards said screen when said loudspeaker enclosure is placed on the ground.

11. The sound system according to claim 1, wherein said loudspeaker enclosure comprises a plurality of loudspeakers.

12. The sound system according to claim 1, comprising at least three identical said loudspeaker enclosures directed towards said screen, each of said loudspeaker enclosures receiving an individual signal.

* * * * *